US008079660B2

(12) United States Patent
Kosugi

(10) Patent No.: US 8,079,660 B2
(45) Date of Patent: Dec. 20, 2011

(54) ELECTRONIC APPARATUS, SEMICONDUCTOR STORAGE DEVICE, PRINT-RECORDING MATERIAL CONTAINER, AND CONTROL DEVICE

(75) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 620 days.

(21) Appl. No.: 12/331,207

(22) Filed: Dec. 9, 2008

(65) Prior Publication Data

US 2009/0153610 A1 Jun. 18, 2009

(30) Foreign Application Priority Data

Dec. 12, 2007 (JP) ..... 2007-320628

(51) Int. Cl.
*B41J 29/393* (2006.01)
*B41J 2/17* (2006.01)
*B41J 2/175* (2006.01)

(52) U.S. Cl. ..... 347/19; 347/84; 347/85

(58) Field of Classification Search ..... 347/19
See application file for complete search history.

(56) References Cited

U.S. PATENT DOCUMENTS

2006/0284919 A1* 12/2006 Kuribayashi et al. ..... 347/19

FOREIGN PATENT DOCUMENTS

JP 2007-001032 1/2007

* cited by examiner

*Primary Examiner* — Uyen Chau N Le
*Assistant Examiner* — Kajli Prince

(57) ABSTRACT

An electronic apparatus includes a plurality of semiconductor storage devices, each of which includes an access determination unit that determines whether the semiconductor storage device is accessed, an input terminal and an output terminal used for connection checking, a normally-closed switching element that electrically disconnects the input terminal from the output terminal when the access determination unit determined that the semiconductor storage device is accessed, and a bypass circuit that electrically connects the input terminal to a reference point through predetermined impedance.

13 Claims, 9 Drawing Sheets

FIG. 5

| DETERMINATION TIMING | | P1 | P2 | P3 | P4 | Q1 | Q2 | Q3 | Q4 | CO |
|---|---|---|---|---|---|---|---|---|---|---|
| AT THE TIME OF COMPLETE-ATTACHMENT DETERMINATION | | Z | Z | Z | Z | ON | ON | ON | ON | LO (1.13V) |
| AT THE TIME OF ATTACHMENT POSITION DETERMINATION | k = 1 | H | * | * | * | OFF | × | × | × | H1 (3.3V) |
| | k = 2 | Z | H | * | * | ON | OFF | × | × | H2 (3.06V) |
| | k = 3 | Z | Z | H | * | ON | ON | OFF | × | H3 (2.87V) |
| | k = 4 | Z | Z | Z | H | ON | ON | ON | OFF | H4 (2.7V) |

" * " DENOTES H/Z-INDEPENDENT
"×" DENOTES ON/OFF INDEPENDENT

FIG. 12

| DETERMINATION TIMING | | P5 | P6 | P7 | P8 | Q5 | Q6 | Q7 | Q8 | CO |
|---|---|---|---|---|---|---|---|---|---|---|
| AT THE TIME OF COMPLETE-ATTACHMENT DETERMINATION | | Z | Z | Z | Z | ON | ON | ON | ON | H10 (2.95) |
| AT THE TIME OF ATTACHMENT POSITION DETERMINATION | k = 1 | L | * | * | * | OFF | × | × | × | H11 (2.48) |
| | k = 2 | Z | L | * | * | ON | OFF | × | × | H12 (2.64) |
| | k = 3 | Z | Z | L | * | ON | ON | OFF | × | H13 (2.78) |
| | k = 4 | Z | Z | Z | L | ON | ON | ON | OFF | H14 (2.92) |

" * " DENOTES L/Z-INDEPENDENT
"×" DENOTES ON/OFF INDEPENDENT

ELECTRONIC APPARATUS, SEMICONDUCTOR STORAGE DEVICE, PRINT-RECORDING MATERIAL CONTAINER, AND CONTROL DEVICE

BACKGROUND

1. Technical Field

The present invention relates to an electronic apparatus including a semiconductor storage device, the semiconductor storage device, a print-recording material container including the semiconductor storage device, and a control device in which the semiconductor storage device is to be mounted.

2. Related Art

In general, detachable ink containers are attached to ink-jet printing apparatuses, for example, serving as electronic apparatuses. Such an ink container may include a semiconductor storage device. The semiconductor storage device stores a variety of information such as information on an amount of remaining ink in the ink container and information on color of ink.

In such a printing apparatus, ink containers for various colors should be attached to corresponding predetermined attachment portions. Therefore, as a technique of preventing ink containers from being attached to wrong attachment portions, a configuration in which light-emitting elements are individually included in a plurality of ink containers which are to be attached to a carriage, and a light-receiving element is included in a main body of the printing apparatus has been proposed (for example, Japanese Unexamined Patent Application Publication No. 2007-1032).

However, the technique in the related art leads to a complicated configuration since the light-emitting elements should be included in the individual ink containers and the light-receiving element should be included in the main body of the printing apparatus. Furthermore, in the technique in the related art, since movement of the carriage should be controlled when an attachment portion is to be determined, a long period of time is required for determining the attachment portion.

SUMMARY

An advantage of some aspects of the invention is to attain a simple configuration of an electronic apparatus and to detect a semiconductor storage device which is attached to a wrong portion of the electronic apparatus at high speed.

The invention has been made in order to address at least part of the foregoing disadvantages, and is realized by the following embodiments or applications.

FIRST APPLICATION EXAMPLE

The electronic apparatus includes a plurality of attachment portions to which a plurality of semiconductor storage devices, each of which includes an access determination unit that determines whether the semiconductor storage device is accessed, an input terminal and an output terminal used for connection checking, a normally-closed switching element that electrically disconnects the input terminal from the output terminal when the access determination unit determined that the semiconductor storage device is accessed, and a bypass circuit that electrically connects the input terminal to a reference point through predetermined impedance, are arranged in a predetermined order, signal lines used to connect the plurality of semiconductor storage devices which are attached to the plurality of attachment portions to one another by bus connection by electrically connecting each of input terminals of the plurality of semiconductor storage devices to corresponding one of output terminals the adjacent semiconductor storage devices as daisy-chain connection, the signal lines being used to access the semiconductor storage devices, a power supply line that supplies power to the input terminal serving a beginning point of the daisy-chain connection through predetermined impedance, a reference point connection line that electrically connects the output terminal serving as an end point of the daisy-chain connection to the reference point, a voltage detection unit that detects a voltage between the input terminal serving as the beginning point and the reference point, an access execution unit that successively accesses the plurality of semiconductor storage devices, a first voltage detection unit that detects a voltage between the input terminal serving as the beginning point and the reference point every time the access execution unit accesses one of the semiconductor storage devices, and an attachment-position determination unit that determines whether the plurality of semiconductor storage devices are properly attached to the corresponding plurality of attachment portions in accordance with the voltage detected using the first voltage detection unit.

According to the electronic apparatus of the first application example, the access unit successively accesses the plurality of semiconductor storage devices, and the first voltage detection unit detects a voltage between the beginning point and the reference point of the daisy-chain connection every time the access execution unit accesses one of the semiconductor storage devices. It is assumed that a certain semiconductor storage device is accessed. In this case, the normally-closed switching element included in the semiconductor storage device is included in the semiconductor storage device, and when the certain semiconductor storage device is accessed, the switching element is brought to a connection state. Therefore, the switching element included in the certain semiconductor storage device is brought to an off state. When the switching element is in the off state, it is difficult to output electric power from the output terminals of the semiconductor storage devices which are arranged upstream of the daisy-chain connection relative to the certain semiconductor storage device and which are other than the certain semiconductor storage device. Accordingly, electric power output from the input terminal is supplied to the reference point through predetermined impedance due to the bypass circuit.

The number of semiconductor storage devices arranged upstream of the daisy-chain connection is varied depending on an order of the certain semiconductor storage device in the daisy-chain connection, and in addition, the number of the related certain impedances is also changed. Accordingly, the voltage between the input terminal serving as the beginning point of the daisy-chain connection and the reference value is determined in accordance with an attachment portion of the certain semiconductor storage device. Therefore, in accordance with voltages detected using the voltage detection unit every time one of the semiconductor storage devices is accessed, the attachment-position determination unit determines whether the plurality of semiconductor storage devices are properly attached to the corresponding attachment portions.

According to the electronic apparatus having the configuration described above, a determination as to whether the semiconductor storage devices are properly attached to the attachment portions is performed with high accuracy. Furthermore, a simple configuration of the electronic apparatus is attained. Moreover, since it is not necessary to physically move the semiconductor storage devices, time required for the determination can be reduced.

SECOND APPLICATION EXAMPLE

The electronic apparatus further includes a second voltage detection unit that detects a voltage between the input terminal serving as the beginning point of the daisy-chain connection and the reference point when the electronic apparatus is turned on or when one of the semiconductor storage devices is attached, and a complete-attachment determination unit that determines whether all the plurality of semiconductor storage devices are attached to the plurality of attachment portions in accordance with the voltage detected using the second voltage detection unit.

With this configuration, in each of the switching elements included in the semiconductor storage devices, the input terminal and the output terminal are electrically connected to each other when the electronic apparatus is turned on or when one of the semiconductor storage devices is attached. Therefore, the voltage detected using the second voltage detection unit between the input terminal serving as the beginning point of the daisy-chain connection and the reference point corresponds to a value obtained by multiplying potential differences generated among the switching elements included in the semiconductor storage devices. When at least one of the semiconductor storage devices is not attached to a corresponding one of the plurality of attachment portions, the voltage detected using the second voltage detection unit is changed. Therefore, it is determined whether all the semiconductor storage devices are attached to the plurality of attachment portions in accordance with the determination based on the voltage.

THIRD APPLICATION EXAMPLE

In the electronic apparatus according to the first application example, the switching element corresponds to a PNP transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed.

With this configuration, the simple switching element is attained using the PNP transistor, for example. Since the PNP transistor serving as the switching element is turned on or off by supplying electric power through the power-supply line, the determination is made using the complete-attachment determination unit before the electric power is supplied to the semiconductor storage devices.

FOURTH APPLICATION EXAMPLE

In the electronic apparatus according to the third application example, the bypass circuit electrically connects the base and the reference point through a resistor. With this configuration, the simple bypass circuit is attained by simply connecting the resistor between the base and the reference point.

FIFTH APPLICATION EXAMPLE

In the electronic apparatus according to the first application example, the switching element corresponds to an NPN transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed. With this configuration, the simple switching element is attained using the NPN transistor, for example.

SIXTH APPLICATION EXAMPLE

In the electronic apparatus according to the sixth application example, each of the plurality of semiconductor storage devices includes an internal circuit at least including the access determination unit, the internal circuit receives power through a power-supply line, and the complete-attachment determination unit executes the determination while the power is supplied to the power-supply line. With this configuration, the determination is made using the complete-attachment determination unit after the electric power is supplied to the semiconductor storage devices.

SEVENTH APPLICATION EXAMPLE

In the electronic apparatus according to the first application example that performs printing using print-recording material, the semiconductor storage devices are included in print-recording material containers having accommodation portions which accommodate the print-recording material, and the print-recording material containers are to be attached to the plurality of attachment portions. With this configuration, in the printing apparatus, the determination as to whether the print-recording material containers are attached to correct portions is made.

EIGHTH APPLICATION EXAMPLE

A semiconductor storage device that is to be attached to an attachment portion included in an electronic apparatus includes an access determination unit that determines whether the semiconductor storage device is externally accessed, an input terminal and an output terminal used for connection checking, a normally-closed switching element that electrically disconnects the input terminal from the output terminal when the access determination unit determined that the semiconductor storage device is accessed, and a bypass circuit that electrically connects the input terminal to a reference point through predetermined impedance.

In the semiconductor storage device according to the eighth application example, the access determination unit determines whether the semiconductor device is externally accessed. When the determination is affirmative, the switching element is switched so that the input terminal and the output terminal are electrically disconnected from each other. When the input terminal and the output terminal are electrically disconnected from each other, the input terminal and the reference point are electrically connected to each other through predetermined impedance using the bypass circuit. Therefore, when the semiconductor storage device is attached to wrong attachment portion, the input terminal is electrically connected to the output terminal, through the switching element. Accordingly, a potential difference defined by the switching element is generated between the input terminal and the output terminal. On the other hand, when the semiconductor storage device is attached to a correct attachment portion, the access determination unit determined that the semiconductor storage device is accessed, and the input terminal is electrically connected to the reference point through predetermined impedance as described above. Consequently, by detecting a voltage between the input terminal and the reference point, it can be determined whether the semiconductor storage device is attached to the correct attachment portion. According to the semiconductor storage device having the configuration described above, the determination as to whether the semiconductor storage device is attached to the correct attachment portion is performed with a simple configuration. In addition, since it is not necessary to physically move the semiconductor storage device for the determination, time required for the determination can be reduced.

Alternatively, each of the print-recording material containers may include the semiconductor storage device according to the eighth application example and a container which contains print-recording material. With this configuration, the print-recording material containers can be used for the determination of attachment portions in the printing apparatus.

Alternatively, a control device in which the semiconductor storage device according to the eighth application example is to be mounted may include a plurality of attachment portions to which a plurality of the semiconductor storage devices are attached in a predetermined order, and which include first contacted-terminals to be connected to the input terminals of the attached semiconductor storage devices and second contacted-terminals to be connected to the output terminals of the attached semiconductor storage devices, signal lines used to connect the first contacted-terminals to the second contacted-terminals of the attachment portions by electrically connecting each of second contacted-terminals of the semiconductor storage devices to corresponding one of the first contacted-terminals of the adjacent semiconductor storage devices as daisy-chain connection, a power supply line that supplies power to one of the first contacted-terminals serving a beginning point of the daisy-chain connection through predetermined impedance, a reference point connection line that electrically connects one of the second contacted-terminals serving as an end point of the daisy-chain connection to the reference point, a voltage detection unit that detects a voltage between one of the first contacted-terminals serving as the beginning point and the reference point, an access execution unit that successively accesses the plurality of semiconductor storage devices, a first voltage detection unit that detects a voltage between one of the first contacted-terminal serving as the beginning point and the reference point every time the access execution unit accesses one of the semiconductor storage devices, and an attachment-position determination unit that determines whether the plurality of semiconductor storage devices are properly attached to the corresponding plurality of attachment portions in accordance with the voltage detected using the first voltage detection unit.

With this configuration, a determination as to whether the semiconductor storage devices are properly attached to the correct attachment portions is performed with high accuracy. Furthermore, a simple configuration of the control device is attained. Moreover, since it is not necessary to physically move the semiconductor storage devices for the determination, time required for the determination can be reduced.

The invention is realized in various application examples or embodiments other than those described above. For example, the invention is realized in a system including an electronic apparatus which is an application example or in a liquid-jet apparatus to which a print-recording material container which is an application example is attached.

BRIEF DESCRIPTION OF THE DRAWINGS

The invention will be described with reference to the accompanying drawings, wherein like numbers reference like elements.

FIG. 5 is a table showing results of simulations of a determination-result signal CO at a time of attachment determination.

FIG. 12 is a table showing results of simulations of a determination-result signal CO at a time of attachment determination.

DESCRIPTION OF EXEMPLARY EMBODIMENTS

An semiconductor storage device according to an aspect of the invention will be described hereinafter on the basis of embodiments with reference to the accompanying drawings.

1. First Embodiment

Figure 1:
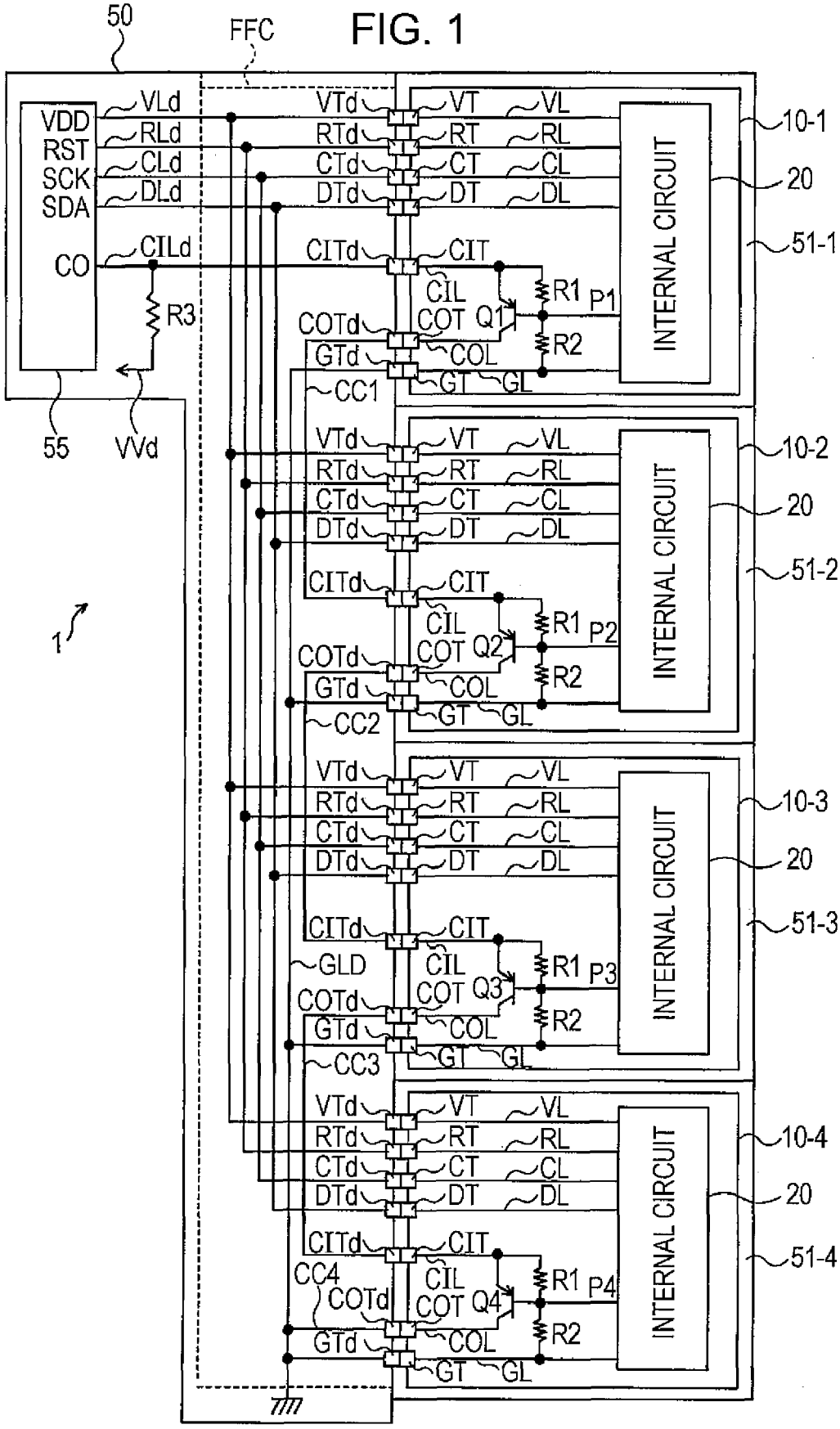
FIG. 1 is a diagram schematically illustrating an electronic apparatus according to a first embodiment of the invention.

FIG. 1 is a diagram schematically illustrating an electronic apparatus according to a first embodiment of the invention. As shown in FIG. 1, an electronic apparatus 1 includes semiconductor storage devices 10 and a control device 50 which is attached to the semiconductor storage devices 10 according to this embodiment to be used.

1-1. Configuration of Semiconductor Storage Device

The semiconductor storage devices 10 of this embodiment are attached to the control device 50 to be used. According to this embodiment, the term "to attach" means a state in which contacts of the semiconductor storage devices 10 are connected to contacts of the control device 50, and is replaceable by terms "to mount" or "to dispose", for example. FIG. 1 shows four semiconductor storage devices 10-1 to 10-4. Since the semiconductor storage devices 10-1 to 10-4 basically have the same configuration, the semiconductor storage devices 10-1 to 10-4 are simply referred to as a semiconductor storage device 10 hereinafter. Note that the number of the semiconductor storage devices 10 is not limited to four, and any number of the semiconductor storage devices 10 may be employed as long as the number is plural.

Figure 2:
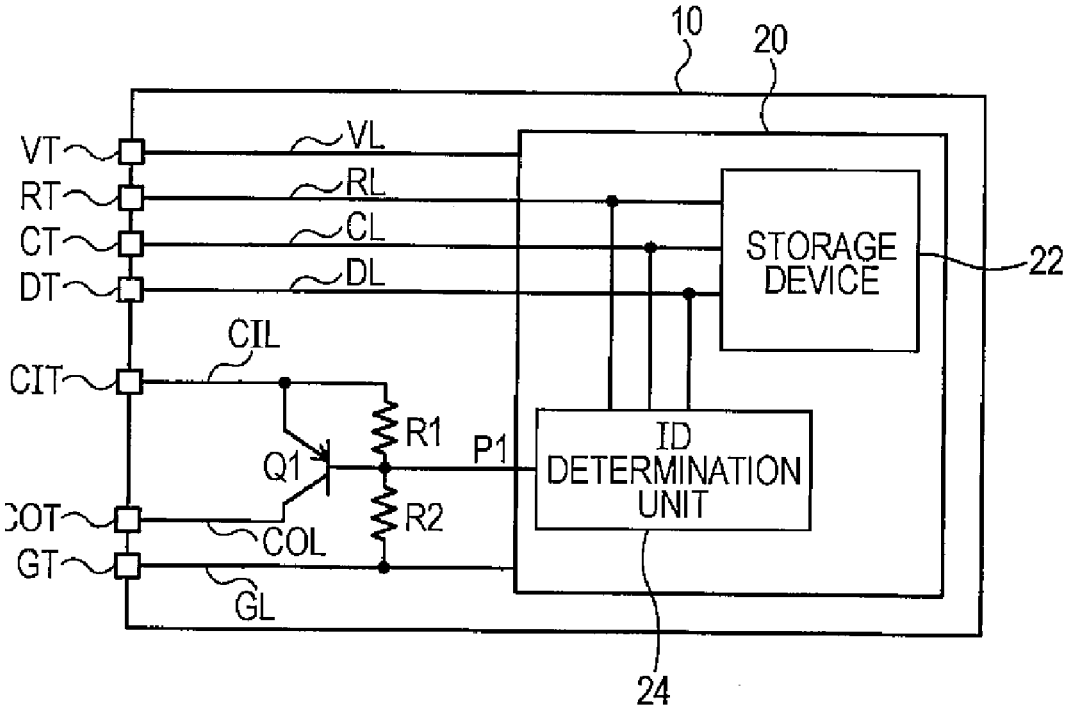
FIG. 2 is a diagram schematically illustrating a configuration of a semiconductor storage device according to the first embodiment.

FIG. 2 is a diagram schematically illustrating a configuration of the semiconductor storage device 10 according to this embodiment. The semiconductor storage device 10 is a so-called memory module, and includes an internal circuit 20 and connection terminals. The connection terminals includes a power supply terminal VT, a reset terminal RT, a clock terminal CT, a data terminal DT, a connection-determination input terminal CIT, a connection-determination output terminal COT, and a ground terminal GT. The power supply terminal VT and the reset terminal RT are connected to the internal circuit 20 through a power supply line VL and a reset signal line RL, respectively. The clock terminal CT, the data terminal DT, and the ground terminal GT are connected to the internal circuit 20 through a clock signal line CL, a data signal line DL, and a ground line GL, respectively. The connection-determination input terminal CIT and the connection-determination output terminal COT are connected to an electronic component group through a connection-determination input-signal line CIL and a connection-determination output-signal line COL, respectively.

The electronic component group connected to the connection-determination input terminal CIT and the connection-determination output terminal COT includes a transistor Q1 and two resistors R1 and R2. The transistor Q1 is a PNP transistor, and an emitter thereof is connected to the connection-determination input-signal line CIL, a collector thereof to the connection-determination output-signal line COL, and a base thereof to the internal circuit 20. The first resistor R1 is interposed between the emitter and the base of the transistor Q1. The second resistor R2 is interposed between the base of the transistor Q1 and the ground line GL, and the base is pulled down using the second resistor R2. A control signal P1 supplied from the internal circuit 20 to the base is in a high-impedance state (Hi-Z) or a high state (H). A circuit including the second resistor R2 interposed between the base and the ground line GL corresponds to a "bypass circuit section" according to an aspect of the invention.

The transistor Q1 normally, that is, in a state in which the control signal P1 is in a Hi-Z state, causes short circuit between the connection-determination input-signal line CIL and the connection-determination output-signal line COL, that is, between the connection-determination input terminal CIT and the connection-determination output terminal COT (while the transistor Q1 is in an on-state). When receiving the control signal P1 which is in an H state, the transistor Q1 electrically disconnects the connection-determination input-signal line CIL from the connection-determination output-signal line COL, that is, disconnects the connection-determination input terminal CIT from the connection-determination output terminal COT (while the transistor Q1 is in an off-state). That is, the transistor Q1 serves as a normally-closed switching device which electrically disconnects the connection-determination input terminal CIT from the connection-determination output terminal COT when receiving the control signal P1 which is in the H state.

The internal circuit 20 includes a storage device (so-called memory chip) 22, a driving unit (not shown) which drives the storage device 22, and an ID determination unit 24. Note that the internal circuit 20 may include other logic circuits. The storage device 22 is connected to the reset signal line RL, the clock signal line CL, and the data signal line DL. In accordance with signals supplied from the reset signal line RL, the clock signal line CL, and the data signal line DL, reading/writing operations (accessing operations) are performed on the storage device 22. Note that the storage device 22 stores identification information (ID) used to identify itself (that is, the semiconductor storage device 10) in advance. That is, the semiconductor storage devices 10-1 to 10-4 have the same configuration except that the semiconductor storage devices 10-1 to 10-4 have different identification information items stored in the corresponding storage devices 22.

The ID determination unit 24 is connected to the reset signal line RL, the clock signal line CL, and the data signal line DL, and determines whether identification information included in a data block supplied form the control device 50 matches the identification information stored in the storage device 22. The storage device 22 allows the reading/writing operations (accessing operations) only when it is determined that the received identification information matches the identification information stored in the storage device 22. That is, since, as described hereinafter, such data terminals DT included in the semiconductor storage devices 10-1 to 10-4 according to this embodiment are connected to a common signal line (as bus connection), the semiconductor storage device 10 should discriminate a data block which is to be transmitted to the semiconductor storage device 10 itself. Therefore, in this embodiment, the identification information is added to the data block so that the semiconductor storage device 10 can determine whether the data block is to be transmitted the semiconductor storage device 10 itself using the identification information.

Furthermore, the ID determination unit 24 outputs the control signal P1 described above to be transmitted to the transistor Q1. The ID determination unit 24 normally outputs the control signal P1 which is in a high impedance (Hi-Z) state (even while the ID determination unit 24 is turned off). However, only when it is determined that the identification information received from the control device 50 matches the identification information stored in the storage device 22, the ID determination unit 24 outputs the control signal P1 which is in a high (H) state in a period corresponding to one clock determined by a signal supplied from the clock signal line CL. That is, only when the identification information received from the control device 50 matches the identification information stored in the storage device 22, a signal which is used to disconnect the emitter from the collector, that is, a signal in a high (H) state is supplied to the base of the transistor Q1.

The configuration of the semiconductor storage device 10 is commonly employed in the semiconductor storage devices 10-1 to 10-4 as described above. Therefore, each of the semiconductor storage devices 10-1 to 10-4 includes such a transistor Q1. Here, the transistors included in the semiconductor storage devices 10-1 to 10-4 are referred to as transistors Q1 to Q4 for convenience of description (refer to FIG. 1). Similarly, control signals supplied to the transistors Q1 to Q4 are referred to as control signals P1 to P4 so that it is easily recognized that the control signals P1 to P4 are generated in the semiconductor storage devices 10-1 to 10-4, respectively.

1-2. Configuration of Control Device

Referring back to FIG. 1, the control device 50 according to this embodiment to which the semiconductor storage device 10 is attached to be used will be described. The control device 50 includes an attachment section 51 to which the semiconductor storage device 10 is to be attached, and a control circuit 55. According to this embodiment, the control device 50 includes first to fourth attachment sections 51-1 to 51-4 corresponding to the semiconductor storage devices 10-1 to 10-4. The first to fourth attachment sections 51-1 to 51-4 each include device terminal groups each including device-side power-supply terminals VTd, device-side reset terminals RTd, device-side clock terminals CTd, device-side data terminals DTd, device-side connection-determination input terminals CITd, device-side connection-determination output terminals COTd, and device-side ground terminals GTd which contact corresponding connection terminal groups each included in the semiconductor storage devices 10-1 to 10-4 (the power supply terminals VT, the reset terminals RT, the clock terminals CT, the data terminals DT, the connection-determination input terminals CIT, the connection-determination output terminals COT, and the ground terminals GT). Note that, in FIG. 1, an attachment section 51 arranged in the first position from the top in the drawing corresponds to the first attachment section 51-1, an attachment section 51 arranged in the second position from the top in the drawing corresponds to the second attachment section 51-2, an attachment section 51 arranged in the third position from the top in the drawing corresponds to the third attachment section 51-3, and an attachment section 51 arranged in the fourth position from the top in the drawing corresponds to the fourth attachment section 51-4. Hereinafter, the first to fourth attachment sections are referred to as attachment sections 51 as needed for convenience of description.

Among the attachment sections 51, when taking adjacent two of the attachment sections 51 as examples, the device-side connection-determination output terminal COTd of one of the two attachment sections 51 is electrically connected to the device-side connection-determination input terminal CITd of the other attachment section 51 through a signal line. Specifically, the device-side connection-determination output terminal COTd of the first attachment section 51-1 is connected to the device-side connection-determination input terminal CITd of the second attachment section 51-2 through a signal line CC1, the device-side connection-determination output terminal COTd of the second attachment section 51-2 is connected to the device-side connection-determination input terminal CITd of the third attachment section 51-3 through a signal line CC2, and the device-side connection-determination output terminal COTd of the third attachment section 51-3 is connected to the device-side connection-determination input terminal CITd of the fourth attachment section 51-4 through a signal line CC3. Accordingly, the semiconductor storage devices 10-1 to 10-4 are connected to one another by daisy-chain connection in a predetermined order. In other words, except for the device-side connection-determination input terminal CITd of the first attachment section 51-1 which is the beginning of the daisy chain connection and the device-side connection-determination output terminal COTd of the fourth attachment section 51-4 which is the end of the daisy chain connection, each of the device-side connection-determination output terminals COTd included in one of the attachment sections 51 is electrically connected to a corresponding one of the device-side connection-determination input terminals CITd included in the adjacent one of the attachment sections 51.

The control circuit 55 is electrically connected to the device-side power-supply terminals VTd, the device-side reset terminals RTd, the device-side clock terminals CTd, and the device-side data terminals DTd included in the first to fourth attachment sections 51-1 to 51-4 through a flat flexible cable FFC including an external power-supply line VLd, an external reset signal line RLd, an external clock signal line CLd, and an external data signal line DLd. That is, the device-side power-supply terminals VTd are connected to the commonly-used external power-supply line VLd, the device-side reset terminals RTd to the commonly-used external reset signal line RLd, the device-side clock terminals CTd to the commonly-used external clock signal line CLd, and the device-side data terminals DTd to the commonly-used external data signal line DLd, as bus connection.

The control circuit 55 is further connected to the device-side side connection-determination input terminal CITd of the first attachment section 51-1 through a connection-determination signal supply line CILd. The connection-determination signal supply line CILd is pulled up by a power-supply device (not shown) through a power-supply line VVd in which a third resistor R3 is arranged in a certain portion thereof.

Furthermore, the device-side ground terminals GTd individually included in the first to fourth attachment sections 51-1 to 51-4 are connected to the ground through an external ground line GLd. The device-side connection-determination output terminal COTd of the fourth attachment section 51-4 is also grounded through a signal line CC4 and the external ground line GLd. The connection line CC4 corresponds to a reference-point connection line section according to an aspect of the invention. The connection-determination signal supply line CILd, the external ground line GLd, and the signal lines CC1 to CC4 are also included in the flat flexible cable FFC.

Figure 3:
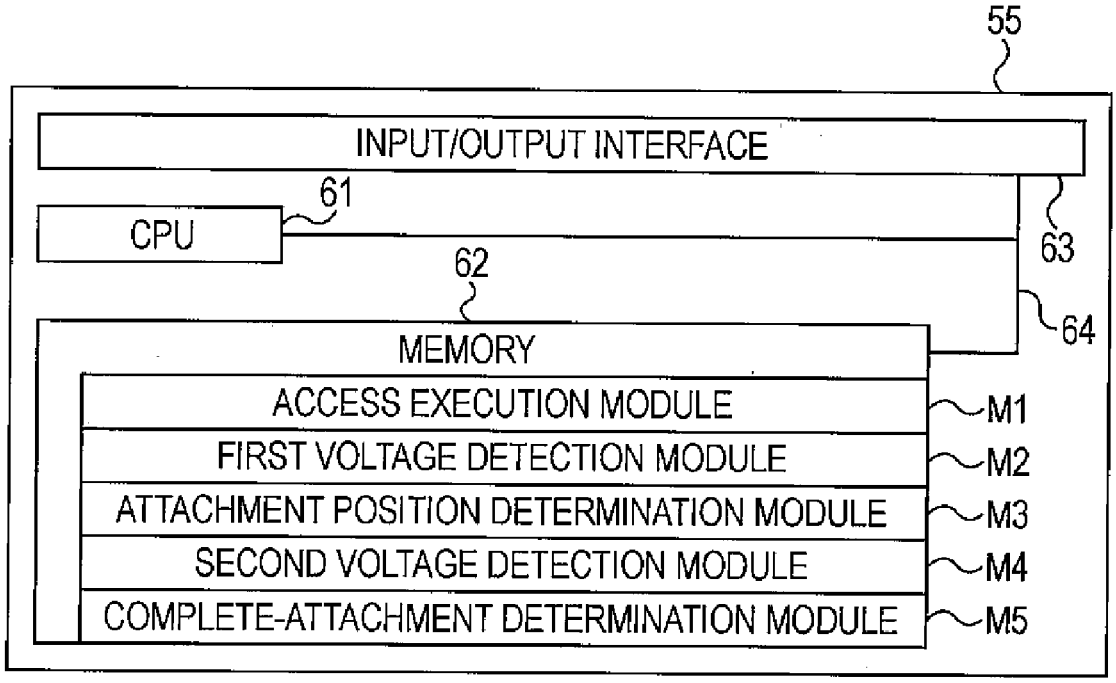
FIG. 3 is a diagram illustrating an internal configuration of a control circuit.

FIG. 3 is a diagram illustrating an internal configuration of the control circuit 55. As shown in FIG. 3, the control circuit 55 includes a central processing unit (CPU) 61 which executes calculation processing, a memory 62 which stores results of calculations and an attachment-determination-processing execution program, for example, and an input/output interface 63 which is electrically connected to the external power-supply line VLd, the external reset signal line RLd, the external clock signal line CLd, and the external data signal line DLd. The CPU 61, the memory 62, and the input/output interface 63 are connected to one another through an internal bus 64.

The memory 62 includes an access execution module M1, a first voltage-detection module M2, an attachment-position determination module M3, a second voltage-detection module M4, and a complete-attachment determination module M5. The access execution module M1 is executed by the CPU 61 so that the semiconductor storage devices 10-1 to 10-4 are sequentially accessed. The first voltage-detection module M2 is executed by the CPU 61 so that a voltage of the connection-determination signal supply line CILd is detected for each access. The attachment-position determination module M3 is executed by the CPU 61 so that it is determined whether the semiconductor storage devices 10-1 to 10-4 are properly attached to the corresponding first to fourth attachment sections 51-1 to 51-4, that is, correct portions, in accordance with voltages detected using the first voltage-detection module M2. The second voltage-detection module M4 is executed by the CPU 61 so that a voltage of the connection-determination signal supply line CILd is detected every time the control device 50 is turned on (the electronic apparatus 1 is turned on) or every time the semiconductor storage device 10 is attached. The complete-attachment determination module M5 is executed by the CPU 61 so that it is determined whether all the semiconductor storage devices 10-1 to 10-4 are attached to the first to fourth attachment sections 51-1 to 51-4 in accordance with voltages detected using the second voltage-detection module M4.

Note that a state in which the semiconductor storage devices 10-1 to 10-4 are attached to the corresponding first to fourth attachment sections 51-1 to 51-4 is referred to a state in which the semiconductor storage devices 10-1 to 10-4 are attached to correct attachment portions. In other words, when the semiconductor storage devices 10 are attached to the correct attachment portions, one of the semiconductor storage devices 10 attached to the first attachment section 51-1 is referred to as the semiconductor storage device 10-1, and similarly, other semiconductor storage devices 10 are referred to as the semiconductor storage device 10-2, the semiconductor storage device 10-3, and the semiconductor storage device 10-4.

In this embodiment, the control circuit 55 outputs a power supply signal VDD to the external power-supply line VLd, a reset signal RST to the external reset signal line RLd, a clock signal SCK to the external clock signal line CLd, and a data signal SDA to the external data signal line DLd. Furthermore, the control circuit 55 receives a determination-result signal CO representing a voltage which is a potential difference from a reference point, i.e., a ground point, from the connection-determination signal supply line CILd. Here, in response to an output of the reset signal RST, a signal level of the external reset signal line RLd is switched from a low level (0) to a high level (1) and vice versa. Similarly, in response to an output of the power supply signal VDD, a potential of the external power-supply line VLd is changed to V (1) or (0).

1-3. Attachment-Determination Processing of Semiconductor Storage Device

Figure 4:
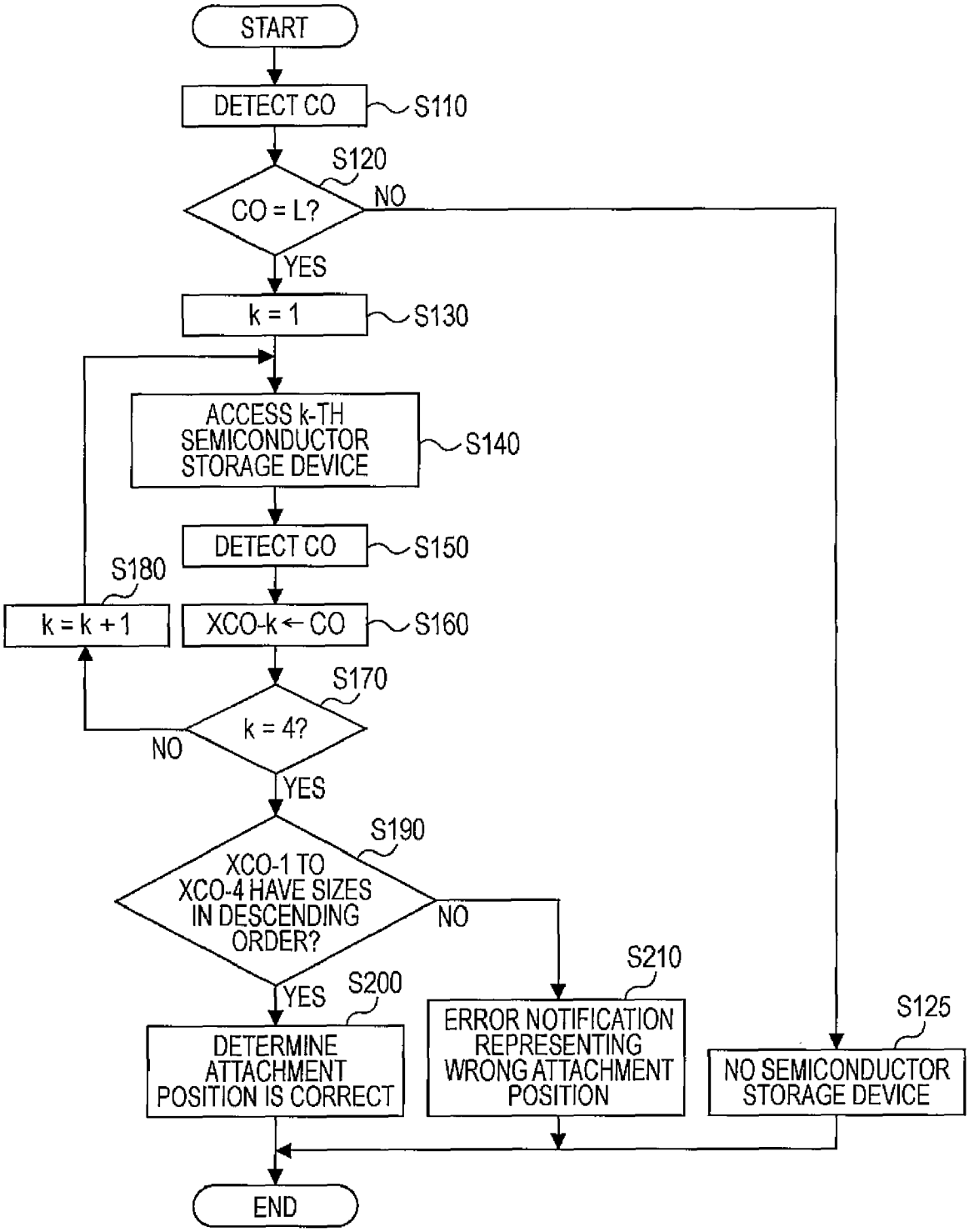
FIG. 4 is a flowchart illustrating attachment determination processing performed using the control circuit.

Referring to FIGS. 4 and 5, processing of determining attachment of the semiconductor storage device 10 performed using the control circuit 55 will be described. FIG. 4 is a flowchart illustrating the attachment determination processing. FIG. 5 is a table showing results of simulations of a determination-result signal CO, for example, at a time of the attachment-determination processing. The attachment-determination processing is performed in accordance with the attachment-determination-processing execution program.

This processing routine shown in FIG. 4 is performed when the control device 50 is turned on or when the semiconductor storage device 10 is detached, attached, or exchanged for a new one. Note that when the control device 50 is turned on, power is supplied from the power-supply line VVd to the connection-determination signal supply line CILd. In this case, however, the control circuit 55 has not yet output the power supply signal VDD, and therefore, a potential of the external power-supply line VLd is 0. On the other hand, when the semiconductor storage device 10 is attached, detached, or exchanged for a new one, power is supplied from the power-supply line VVd to the connection-determination signal supply line CILd, and in addition, since the control circuit 55 outputs the power supply signal VDD, the potential of the external power-supply line VLd is V(1).

When this processing routine is started, the CPU 61 of the control circuit 55 first detects a determination-result signal CO representing a voltage of the connection-determination signal supply line CILd in step S100. As described above, the power-supply device is connected through the power-supply line VVd and the third resistor R3 to the connection-determination signal supply line CILd. Therefore, when none of the semiconductor storage devices 10-1 to 10-4 are attached to the first to fourth attachment sections 51-1 to 51-4, the determination-result signal CO detected in step S100 is in a high (H) state. Note that a state in which the semiconductor storage device 10-1 is not attached to the first attachment section 51-1 is substantially equal to a state in which none of the semiconductor storage devices 10-2 to 10-4 is attached to the other attachment sections 51-2 to 51-4 which are connected by the daisy-chain connection as viewed from the connection-determination signal supply line CILd. Therefore, in at least a case where the semiconductor storage device 10-1 is not attached to the first attachment section 51-1, the determination-result signal CO detected in step S100 is in the high (H) state.

After the processing of step S110, the CPU 61 determines whether the determination-result signal CO detected in step S110 is in a low (L) state in step S120. As described above, since the ID determination unit 24 normally outputs the control signal P1 in a Hi-Z state (even while the ID determination unit 24 is turned off), all the transistors Q1 to Q4 of the semiconductor storage devices 10-1 to 10-4 are in on states when this processing routine is started (refer to a second column of the table shown in FIG. 5). Since the power supply device is connected through the power-supply line VVd and the third resistor R3 to the connection-determination signal supply line CILd, the transistors Q1 to Q4 are in on states even when the control signal P1 supplied to the base is in the Hi-Z state. In other words, at the time when this processing routine is started, the transistors Q1 to Q4 are in on states irrespective of whether power is supplied to the semiconductor storage devices 10-1 to 10-4.

Here, a potential difference Vce between the emitter and the collector of each pairs of the first to third transistors Q1 to Q3 is approximately 0.1 V, and a potential difference Vce between the emitter and the collector of the fourth transistor Q4 is approximately 0.7 V. Therefore, when all the semiconductor storage devices 10-1 to 10-4 are attached to the first to fourth attachment sections 51-1 to 51-4, a value of the determination-result signal CO detected in step S110 is obtained by the following equation: 0.1+0.1+0.1+0.7=1.0 V. The value is actually in a range from approximately 1.0 to approximately 1.1 V, and here, it is assumed that the value is 1.13 V. This value, i.e., 1.13 V is determined as a value of the determination-result signal CO which is in the low (L) state. That is, in step S120, it is determined whether the value of the determination-result signal CO is within a range of 1.13 V±α (α denotes a small value) whereby it is determined whether all the semiconductor storage devices 10-1 to 10-4 are attached to the first to fourth attachment sections 51-1 to 51-4. Note that, in FIG. 5, the value of 1.13 V denoted by "LO".

In step S120, when it is determined that the determination-result signal CO is in the low (L) state, it is determined that the semiconductor storage devices 10-1 to 10-4 are attached to the first to fourth attachment sections 51-1 to 51-4, and the process proceeds to step S130. On the other hand, when it is determined that the determination-result signal CO is in the high (H) state, for example, in at least the case where the semiconductor storage device 10-1 is not attached to the first attachment section 51-1 and therefore the determination-result signal CO is in the high (H) state, it is determined that at least one of the first to fourth attachment sections 51-1 to 51-4 does not have the semiconductor storage device 10 attached thereto in step S125. In this case, this processing routine is terminated. Note that the control circuit 55 may transmit a notification representing that at least one of the first to fourth attachment sections 51-1 to 51-4 does not have the semiconductor storage device 10 attached thereto through a display unit or an indicating light unit.

In step S130, the CPU 61 sets 1 to a counter value k which is used when the number of the semiconductor storage devices 10 is counted. Then, the CPU 61 performs processing of accessing a k-th semiconductor storage device 10 determined by the counter value k in step S140. Specifically, a data signal SDA representing a data block including identification information which identifies the k-th semiconductor storage device 10 is transmitted through the data signal line DL to the external data signal line DLd. Note that, in a case where this processing routine is executed in response to turning-on of the control device 50, the control circuit 55 has not yet output the power supply signal VDD, and therefore, a potential of the external power-supply line VLd is 0. Therefore, processing of outputting the power supply signal VDD is performed before the processing of step S140.

Subsequently, the CPU 61 detects the determination-result signal CO representing the voltage of the connection-determination signal supply line CILd in step S150. The CPU 61 stores the detected determination-result signal CO in a k-th voltage storage area XCO-k in step S160. Thereafter, the CPU 61 determines whether the counter value k reaches 4 which is the total number of the semiconductor storage devices 10 in step S170. Here, when the determination is negative in step S170, the CPU 61 increments the counter value k (k=k+1) in step S180, and the process returns to step S140. Thereafter, the processing from step S140 to step S170 is repeatedly performed until the counter value k corresponds to 4. When the counter value k corresponds to 4, the process proceeds to step S190.

Since the processing from step S140 to step S170 is repeatedly performed, the first to fourth semiconductor storage devices 10-1 to 10-4 are sequentially accessed. In addition, voltage values of the determination-result signal CO detected every time the accessing operation is performed can be stored in first to fourth voltage storage areas XCO-1 to XCO-4. In step S190, the CPU 61 determines whether the values are stored in the first to fourth voltage storage areas XCO-1 to XCO-4 in descending order, that is, whether the following expression is obtained: XCO-1>XCO-2>XCO-3>XCO-4. Possible values to be stored in the first to fourth voltage storage areas XCO-1 to XCO-4 will be described hereinafter.

(i) Counter Value k=1

It is assumed that the counter value k is 1 and the semiconductor storage device 10-1 is accessed. In this case, in the semiconductor storage device 10-1, the ID determination unit 24 outputs a signal in a high (H) state for a period of one clock and the transistor Q1 is in an off state. Since all the semiconductor storage devices 10-1 to 10-4 are connected to one another as the bus connection, the transistor Q1 is in the off state when the semiconductor storage device 10-1 is disposed in any one of the first to fourth attachment sections 51-1 to 51-4.

Figure 6:
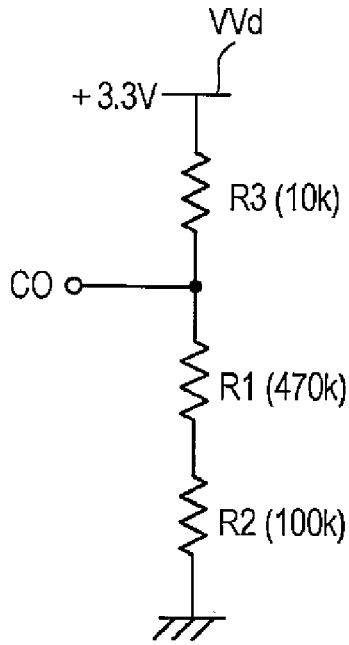
FIG. 6 is a diagram illustrating an equivalent circuit when a first semiconductor storage device is accessed.

It is assumed that the semiconductor storage device 10-1 is attached to the correct attachment portion, that is, first attachment section 51-1, the transistor Q1 of the semiconductor storage device 10-1 attached to the first attachment section 51-1 is brought to an off state (refer to the third column of the table shown in FIG. 5). FIG. 6 shows an equivalent circuit of the electronic apparatus 1 of this case. Here, it is assumed that power supplied from the power-supply line VVd is 3.3 V, a resistance value of the first resistor R1 connected to the transistor Q1 is 470 k Ω, a resistance value of the second resistor R2 is 100 k Ω, and a resistance value of the third resistor R3 disposed in the power-supply line VVd is 10 k Ω. That is, the following expression is obtained: R3<R2<R1.

When the transistor Q1 of the semiconductor storage device 10-1 attached to the first attachment section 51-1 is in the off state, circuits connected through the signal lines CC1 to CC3 as the daisy-chain connection may be ignored. Therefore, as shown in FIG. 6, the equivalent circuit is constituted only using the first and second resistors R1 and R2 included in the first attachment section 51-1 and the third resistor R3 connected to the power-supply line VVd. Since a total resistance value of the first resistor R1 and the second resistor R2 is larger than the resistance value of the third resistor R3, a voltage of the determination-result signal CO is substantially equal to the supplied voltage, that is, 3.3 V.

(ii) Counter Value k=2

Figure 7:
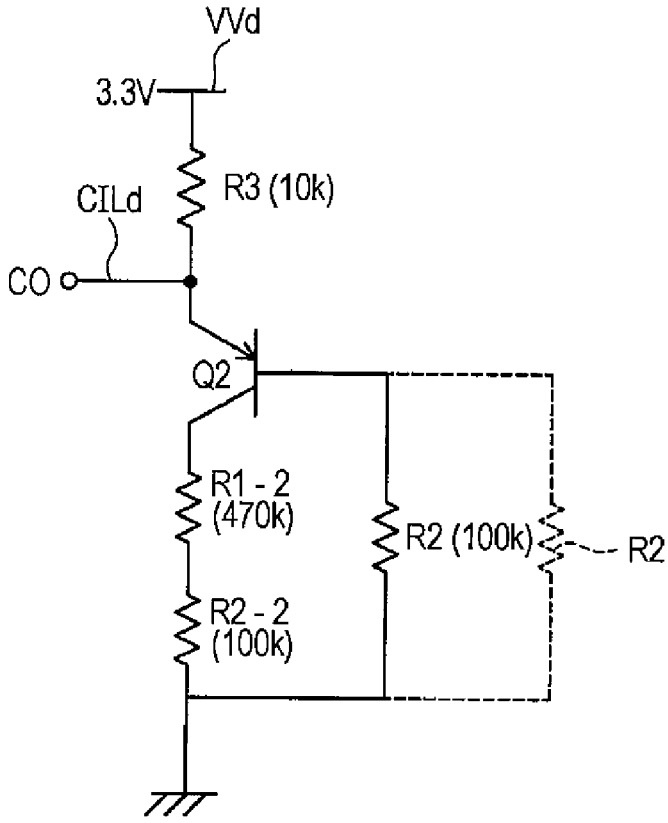
FIG. 7 is a diagram illustrating an equivalent circuit when a second semiconductor storage device is accessed.

It is assumed that the counter value k is 2 and the semiconductor storage device 10-2 is accessed. In this case, in the semiconductor storage device 10-2, the ID determination unit 24 outputs a signal in a high (H) state for a period of one clock and the transistor Q2 is brought to an off state (refer to the fourth column of the table shown in FIG. 5). Here, it is assumed that the semiconductor storage device 10-2 is attached to the correct attachment portion, that is, the second attachment section 51-2, the transistor Q2 of the semiconductor storage device 10-2 attached to the second attachment section 51-2 is brought to an off state. FIG. 7 shows an equivalent circuit of the electronic apparatus 1 of this case. Since the circuits connected through the signal lines CC2 and CC3 as the daisy-chain connection may be ignored, as shown in FIG. 7, the equivalent circuit is constituted by first and second resistors R1-2 and R2-2 included in the second attachment section 51-2, the second resistor R2 included in the first attachment section 51-1, and the third resistor R3 connected to the power-supply line VVd. Note that although the first and second resistors R1-2 and R2-2 are the same as the first and second resistors R1 and R2, "-2" is added to the reference symbols for the purpose of indicating that the first and second resistors R1-2 and R2-2 are included in the second attachment section 51-2. Here, the resistance value of the resistor R2 of the semiconductor storage device 10 attached to the first attachment section 51-1 is employed. This is because, when the transistor Q2 included in the second attachment section 51-2 is brought to an off state, the collector of the transistor Q1 included in the first attachment section 51-1 is brought to an open state and the current from the emitter is not supplied to the collector but to the base. The current supplied to the base is further supplied through the second resistor R2 to the ground line GL.

Accordingly, when the counter value k is 2, a configuration in which the resistor R2 is added to a configuration in the case where the counter value k is 1 shown in FIG. 6 in parallel is employed. A total resistance value between the connection-determination signal supply line CILd and the ground point is smaller than that in the case where the counter value k is 1. Accordingly, a magnitude (voltage) of the determination-result signal CO supplied through the connection-determination signal supply line CILd is smaller than that in the case where the counter value k is 1 shown in FIG. 6.

(iii) Counter Value k=3 or 4

In a case where the counter value k is 3 and the semiconductor storage device 10-3 is accessed, an equivalent circuit is obtained, as indicated by a dotted line in FIG. 7, by adding another second resistor R2 to the equivalent circuit in the case where the semiconductor storage device 10-2 is accessed. Therefore, a total resistance value between the connection-determination signal supply line CILd and the ground point is smaller than that in the case where the counter value k is 2. Accordingly, the magnitude (voltage) of the determination-result signal CO supplied through the connection-determination signal supply line CILd is smaller than that in the case where the counter value k is 2. Similarly, in a case where the counter value k is 4 and the fourth semiconductor storage device 10-4 is accessed, the magnitude (voltage) of the determination-result signal CO is smaller than that in the case where the counter value k is 3.

According to the cases (i) to (iii), when the semiconductor storage devices 10-1 to 10-4 are attached to the corresponding correct attachment portions, that is, the corresponding first to fourth attachment sections 51-1 to 51-4, values are stored in the first to fourth voltage storage areas XCO-1 to XCO-4 in descending order in step S160. The values of the first to fourth voltage storage areas XCO-1 to XCO-4 are denoted by H1 to H4 as shown in the rightmost row of the table in FIG. 5. As described above, assuming that the supplied power is 3.3 V, the resistance value of the resistor R1 is 470 k Ω, the resistance value of the resistor R2 is 100 k Ω, and the resistance value of the third resistor R3 is 10 k Ω, results of simulations are obtained as follows: H1=3.3 V, H2=3.06 V, H3=2.87 V, and H4=2.7 V.

Accordingly, by determining whether the values are stored in the first to fourth voltage storage areas XCO-1 to XCO-4 in descending order in step S190, it is determined whether the semiconductor storage devices 10-1 to 10-4 are attached to the correct attachment portions, that is, the corresponding first to fourth attachment sections 51-1 to 51-4 or it is determined whether the arrangement of the semiconductor storage devices 10-1 to 10-4 to the first to fourth attachment sections 51-1 to 51-4 is correct.

When the determination is affirmative in step S190, it is determined that the semiconductor storage devices 10-1 to 10-4 are attached to the corresponding correct attachment portions in step S200, and this processing routine is terminated. The control circuit 55 may perform an operation of controlling a display of notification representing that the semiconductor storage devices 10-1 to 10-4 have been attached to the corresponding correct attachment portions. On the other hand, when the determination is negative in step S190, error notification is performed in step S210, and then, this processing routine is terminated. Note that the control circuit 55 may perform notification representing that one of the semiconductor storage devices 10-1 to 10-4 is attached to a wrong attachment portion, that is, notification representing the wrong arrangement using the display unit or the indicating light unit.

The processing performed in step S110 in the attachment-determination processing having the configuration described above corresponds to the second voltage-detection module M4 (refer to FIG. 3), the processing performed in step S120 corresponds to the complete-attachment determination module M5 (refer to FIG. 3), the processing performed in step S140 corresponds to the access execution module M1 (refer to FIG. 3), the processing performed in step S150 and step S160 corresponds to the first voltage-detection module M2, and the processing performed in step S190 corresponds to the attachment-position determination module M3 (refer to FIG. 3).

1-4. Advantages of Embodiment

As described above, according to the electronic apparatus 1 and the control device 50 of this embodiment, it can be determined whether the semiconductor storage devices 10-1 to 10-4 are attached to the corresponding first to fourth attachment sections 51-1 to 51-4, that is, the corresponding correct attachment portions (in other words, whether the semiconductor storage devices 10-1 to 10-4 are correctly arranged). Furthermore, according to the electronic apparatus 1 and the control device 50 of this embodiment, the determination as to whether the semiconductor storage devices 10-1 to 10-4 are attached to the corresponding first to fourth attachment sections 51-1 to 51-4 can be made before power is supplied to the semiconductor storage devices 10-1 to 10-4. Moreover, the high-accuracy determination can be made while the simple configurations of the semiconductor storage device 10 and the control device 50 are attained. In addition, since it is not necessary to physically move the semiconductor storage device 10 for the determination, time required for the determination can be reduced.

1-5. Application Examples

Figure 8:
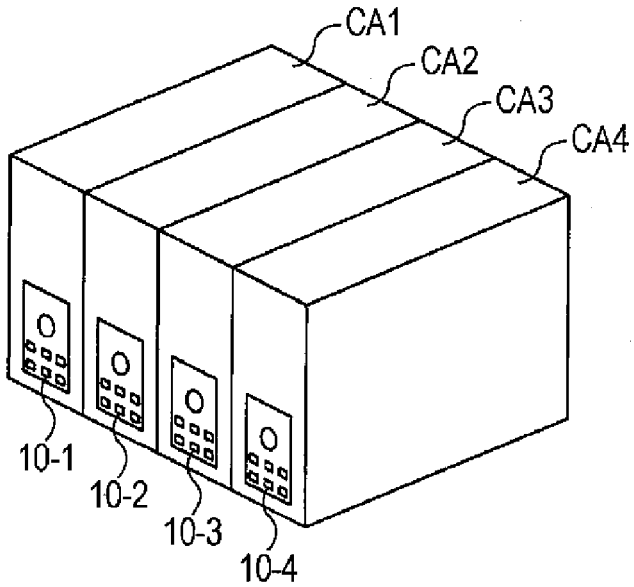
FIG. 8 is a diagram illustrating ink cartridges each of which includes the semiconductor storage device according to the first embodiment.
Figure 9:
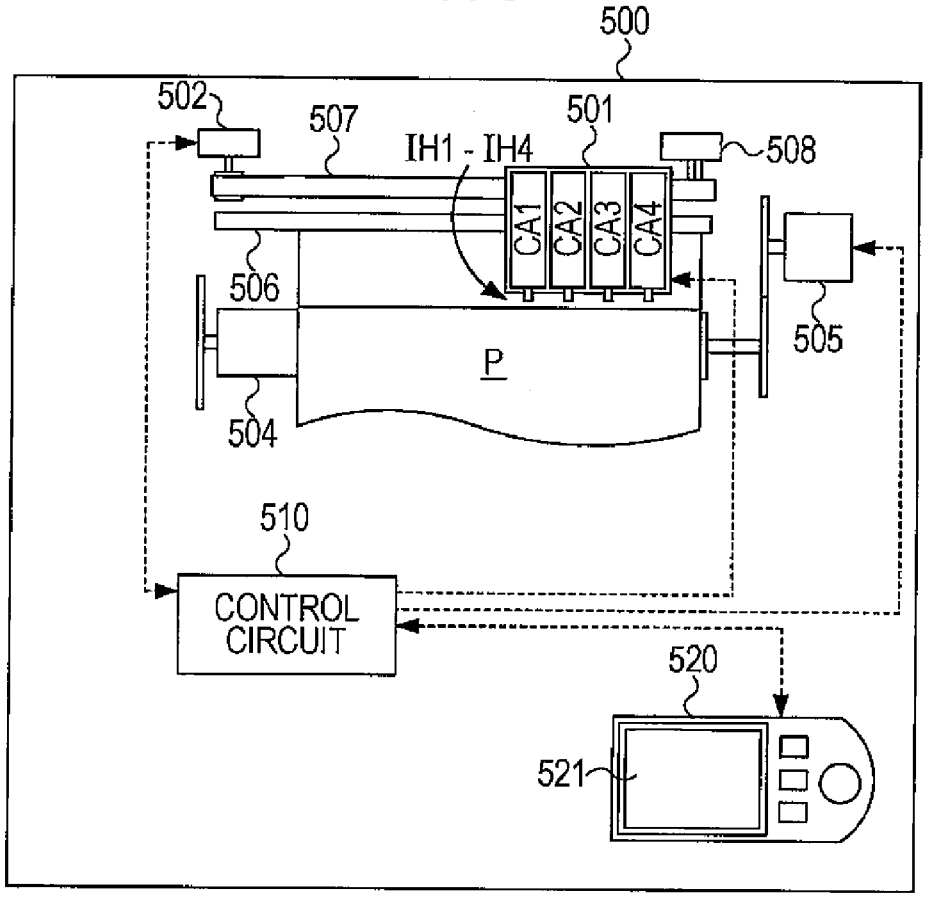
FIG. 9 is a diagram schematically illustrating a functional configuration of a printing apparatus serving as a control device or the electronic apparatus according to the first embodiment.

Referring to FIGS. 8 and 9, application examples of the semiconductor storage device 10 and the electronic apparatus 1 according to the first embodiment will be described. FIG. 8 is a diagram illustrating ink cartridges each include the semiconductor storage devices according to the first embodiment. FIG. 9 is a diagram schematically illustrating a functional configuration of a printing apparatus serving as the control device or the electronic apparatus according to the first embodiment.

The semiconductor storage devices 10-1 to 10-4 are attached to corresponding ink cartridges (print-recording material containers) CA1 to CA4. The ink cartridges CA1 to CA4 include ink containers which contain ink inside thereof. Information on the ink stored in the ink containers (for example, information on an amount of remaining ink or information on color of ink) is stored in each of the storage devices 22 included in the semiconductor storage devices 10-1 to 10-4.

Referring to FIG. 9, a printing apparatus 500 includes a control circuit 510, an operation unit 520, and a printing unit. The printing unit includes a mechanism which drives printing heads IH1 to IH4 disposed in a carriage 501 so that the ink is ejected and dots are formed, a mechanism which causes the carriage 501 to perform reciprocating movement in an axial direction of a platen 504, and a mechanism which transports a printing sheet P using a sheet feeding motor 505. The mechanism which causes the carriage 501 to perform reciprocating movement in the axial direction of the platen 504 includes a sliding shaft 506 which slidably holds the carriage 501 which is hung in parallel to the axis of the platen 504, a pulley 508 which is used to dispose an endless driving belt 507 in a tensioned state between the pulley 508 and a carriage motor 502, and a position sensor (not shown) which detects an origin position of the carriage 501. The mechanism which transports the printing sheet P includes the platen 504, the sheet-feeding motor 505, a sheet-feeding auxiliary roller (not shown), and a gear train (not shown) which transmits rotation of the sheet feeding motor 505 to the platen 504 and the sheet-feeding auxiliary roller.

The carriage 501 includes attachment portions to which the ink cartridges CA1 to CA4 are attached. The ink cartridge CA1 contains black (K) ink, the ink cartridge CA2 contains cyan (C) ink, the ink cartridge CA3 contains magenta (M) ink, and the ink cartridge CA4 contains yellow (Y) ink. Note that, in addition to these, other ink cartridges which contain light-cyan (LC) ink, light magenta (LM) ink, dark yellow (DY) ink, light black (LB) ink, red (R) ink, and blue (B) ink may be attached to the attachment portions.

The attachment portions of the carriage 501 include the external terminal groups described above. The external terminal groups contact to the terminal groups of the semiconductor storage devices 10-1 to 10-4 included in the ink cartridges CA1 to CA4 whereby the control circuit 510 can write data into the storage devices 22 and read data from the storage devices 22.

The control circuit 510 performs printing processing using the printing apparatus 500 and performs data reading/writing processing on the storage device 22. As with the control circuit 55, the control circuit 510 includes a central processing unit (CPU), a memory, an input/output (I/O) interface, and an internal bus.

The operation unit 520 includes a display unit 521 which displays various items. The control circuit 510 may instructs the display unit 521 to display notification representing one of the attachment portion in which a corresponding one of the ink cartridges CA1 to CA4 is not properly attached. Alternatively, when the printing apparatus 500 has indicating light units corresponding to the attachment portions, the control circuit 510 may instructs one of the indicating light units which corresponds to one of the attachment portions in which a corresponding one of the ink cartridges CA1 to CA4 is not properly attached to be turned on, to blink, or to be turned off.

2. Second Embodiment

Figure 10:
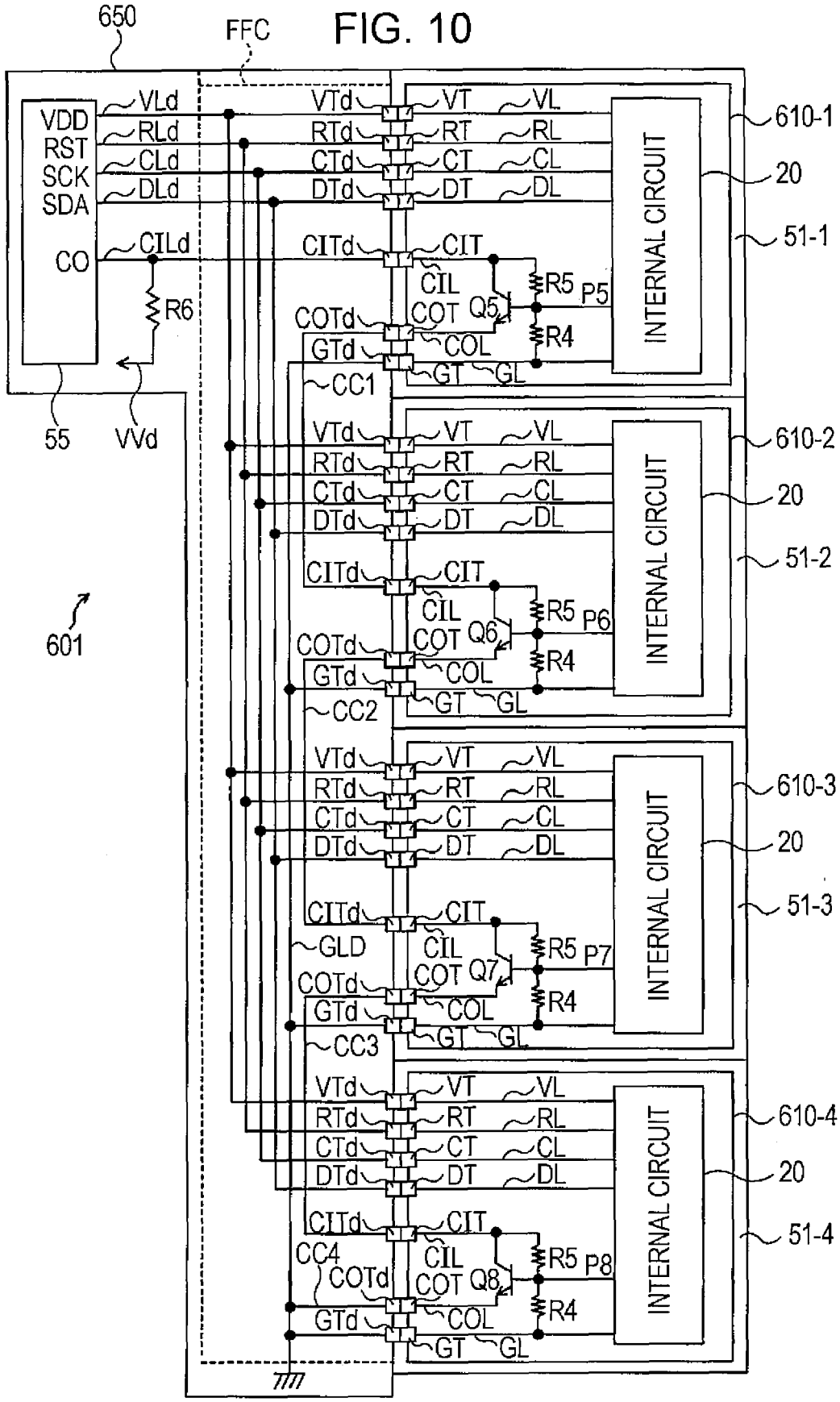
FIG. 10 is a diagram schematically illustrating an electronic apparatus according to a second embodiment.

FIG. 10 is a diagram schematically illustrating an electronic apparatus according to a second embodiment. As shown in FIG. 10, the electronic apparatus 601 is different from the electronic apparatus 1 according to the first embodiment in that semiconductor storage devices 610-1 to 610-4 (hereinafter referred to as a "semiconductor storage device 610" as needed) include NPN transistors Q5 to Q8, respectively. Collectors of the transistors Q5 to Q8 are connected to corresponding connection-determination input terminals CIT, and emitters are connected to corresponding connection-determination output terminals COT. First resistors R4 are individually connected between bases of the transistors Q5 to Q8 and a ground line GL, and second resistors R5 are individually connected between the collectors and the bases of the transistors Q5 to Q8. It is assumed that, in this embodiment, resistance values of the first resistors R4 are 470 k Ω, resistance values of the second resistors R5 are 100 k Ω, and resistance values of a third resistor R6 connected to a power-supply line VVd is 33 k Ω. That is, the following expression is obtained: R4<R5<R6. Note that the first resistors R4 have the resistance values the same as those of the first resistors R1 of the first embodiment, and the second resistors R5 have the resistance values the same as those of the second resistors R2 of the first embodiment. Circuits each including the second resistors R5 arranged between pairs of the collectors and the bases correspond to "bypass circuit sections" according to an aspect of the invention.

Note that, in each of the semiconductor storage devices 610-1 to 610-4, an ID determination unit included in an internal circuit 20 of this embodiment normally outputs a control signal P1 which is in an high impedance (Hi-Z) state (even when the ID determination unit is turned off), and only when identification information received from a control device 650 matches identification information stored in a storage device 22, the ID determination unit outputs a signal which is in a low (L) state for a period of one clock defined by a signal supplied from a clock signal line CL. The transistors Q5 to Q8 are turned off when such control signals P1 which are in a low (L) state are output.

Portions of a hardware configuration other than this are the same as those of the first embodiment. Note that components of the second embodiment which are the same as those of the first embodiment are denoted by reference numerals the same as those of the first embodiment.

Figure 11:
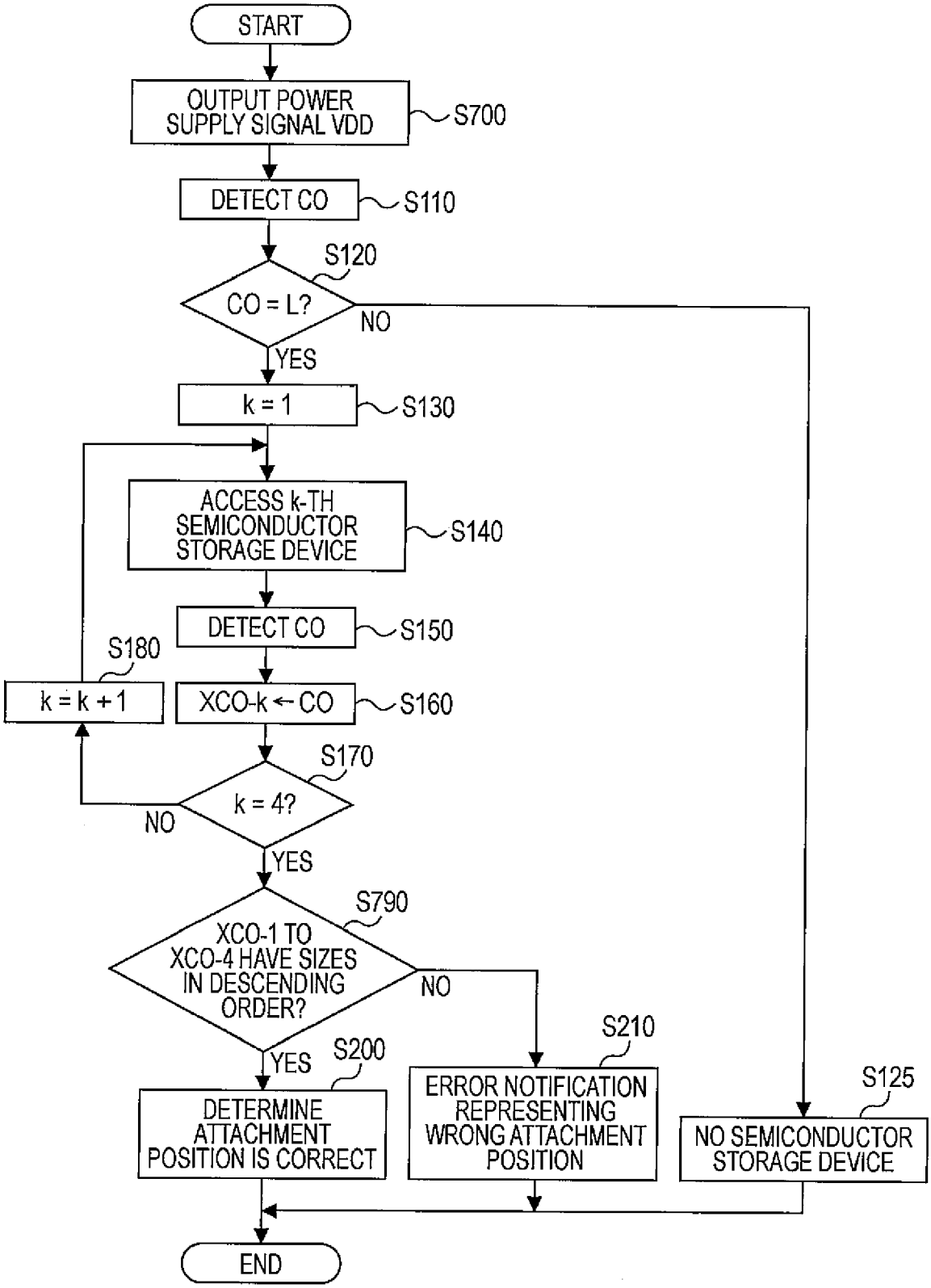
FIG. 11 is a flowchart illustrating attachment determination processing according to the second embodiment.

Referring to FIGS. 11 and 12, processing of determining whether the semiconductor storage device 610 is properly attached performed using the control circuit 55 will be described. FIG. 11 is a flowchart illustrating the attachment-determination processing. FIG. 12 is a table showing results of simulations of a determination-result signal CO when the attachment-determination processing is performed.

This processing routine shown in FIG. 4 is performed when the control device 650 is turned on or when the semiconductor storage device 610 is detached, attached, or exchanged for a new one. When this processing routine is started, a CPU 61 included in the control device 650 outputs a power supply signal VDD to an external power-supply line VLd in step S700. That is, first, it is assumed that a potential of the external power-supply line VLd is 1 V, and power is supplied to the semiconductor storage device 610. Thereafter, processing the same as that performed in step S110 to step S180 of the first embodiment is performed. When it is determined that a counter value k reaches 4 in step S170, the process proceeds to step S790.

In step S190 of the first embodiment, it is determined whether the values of the first to fourth voltage storage areas XCO-1 to XCO-4 are stored in descending order in step S160. On the other hand, in step S790 of this embodiment, it is determined whether values are stored in first to fourth voltage storage areas XCO-1 to XCO-4 in ascending order in step S160, that is, whether the following expression is obtained: XCO-1<XCO-2<XCO-3<XCO-4. Possible values to be stored in the first to fourth voltage storage areas XCO-1 to XCO-4 will be described hereinafter.

FIG. 12 is a table showing results of simulations of the determination-result signal CO according to the second embodiment. This simulation results are obtained assuming that supplied power is 3.3 V, resistance values of the first resistors R4 are 470 k Ω, resistance values of the second resistors R5 are 100 k Ω, and a resistance value of the third resistor R3 is 33 k Ω. The determination-result signal CO is H10 (=2.95 V) when complete-attachment determination is performed. During the attachment-position determination processing, the determination-result signal CO is H11 (2.48 V) when the first semiconductor storage device 610-1 is accessed (k=1), the determination-result signal CO is H12 (2.64 V), when the second semiconductor storage device 610-2 is accessed (k=2), the determination-result signal CO is H13 (2.78 V) when the third semiconductor storage device 610-3 is accessed (k=3), the determination-result signal CO is H14 (2.92 V) when the fourth semiconductor storage device 610-4 is accessed (k=4). That is, the following expression is obtained: H11<H12<H13<H14<H10.

Accordingly, by determining whether the values are stored in the first to fourth voltage storage areas XCO-1 to XCO-4 in ascending order in step S790, it is determined whether the semiconductor storage devices 610-1 to 610-4 are attached to the correct attachment portions, that is, the corresponding first to fourth attachment sections 51-1 to 51-4 or it is determined whether the arrangement of the semiconductor storage devices 610-1 to 610-4 to the first to fourth attachment sections 51-1 to 51-4 is correct. Thereafter, the processing the same as that performed in step S200 and step S210 is performed before this processing routine is terminated.

According to the electronic apparatus 601 of the second embodiment which is configured as described above, it can be determined whether the semiconductor storage devices 610-1 to 610-4 are attached to the corresponding first to fourth attachment sections 51-1 to 51-4, that is, the corresponding correct attachment portions (in other words, whether the semiconductor storage devices 10-1 to 10-4 are correctly arranged). Furthermore, the determination as to whether the semiconductor storage devices 10-1 to 10-4 are attached to the corresponding first to fourth attachment sections 51-1 to 51-4 can be made. Moreover, the high-accuracy determination can be made while the simple configurations of the semiconductor storage device 610 and the control device 650 are attained. In addition, since it is not necessary to physically move the semiconductor storage device 610 for the determination, time required for the determination can be reduced.

Note that, as with the first embodiment, the semiconductor storage device 610 and the electronic apparatus 601 may be used as the semiconductor storage device 610 including an ink cartridge and a printing apparatus, respectively.

3. Other Embodiments (1) The transistors Q1 to Q4 employed in the first embodiment are PNP transistors, and the transistors Q5 to Q9 employed in the second embodiment are NPN transistors. However, various transistors may be employed, such as PMOS transistors, NMOS transistors, PNP bipolar transistors, and NPN bipolar transistors, as long as the transistors have a switching function required in the embodiments. Furthermore, various switching devices may be employed instead of the transistors.

(2) According to the foregoing embodiments, the semiconductor storage device 10, the semiconductor storage device 610, the control device 50, and the control device 650 have configurations of circuits to which direct current is supplied thereto. However, instead of these, the semiconductor storage device 10, the semiconductor storage device 610, the control device 50, and the control device 650 may have configurations of circuits to which alternate current is supplied. In this case, the resistors R2 and R5 which are included in bypass circuits are constituted by coils having inductance.

(3) According to each of the foregoing embodiment, one of the connection-determination output terminals COT which is a terminal point of the daisy-chain connection of the plurality of semiconductor storage devices is directly grounded. However, the connection-determination output terminal COT which is the terminal point may be connected to a ground point through predetermined impedance.

(4) The magnitude of the power supplied from the power-supply line VVd, the resistance values of the resistors R1 to R3, and the resistance values of the resistors R4 to R6 are merely examples and may be changed to various magnitudes. Furthermore, circuit configurations are not limited to the circuit configurations of the foregoing embodiments and various circuit configurations may be employed without departing from the scope of the invention.

(5) The ID determination unit 24 according to each of the foregoing embodiments has a configuration in which the control signal P1 which is in the Hi-Z state is normally output, but the control signal P1 which is in the high (High) state is output only when the identification information received from the control device 50 matches the identification information stored in the storage device 22. However, instead of this configuration, a configuration including a three-state buffer having an input-signal terminal connected to the power-supply line and the ID determination unit may be employed. When the ID determination unit determines that the identification information received from the control apparatus matches the identification information stored in the storage device, an enable signal is supplied to the three-state buffer. By this, the configuration in which the control signal P1 of the Hi-Z state is normally output and the control signal P1 of the high (H) state is output only when the identification information received from the control apparatus matches the identification information stored in the storage device can be easily realized.

(6) According to the foregoing embodiments, an ink cartridge is taken as an application example of the semiconductor storage device 10. However, the semiconductor storage device 10 may be employed in a tonner cartridge or an ink-ribbon cartridge, for example. Furthermore, according to the foregoing embodiments, an ink-jet printer is taken as an example of the electronic apparatus 1 and the electronic apparatus 601. However, the electronic apparatus 1 and the electronic apparatus 601 may be realized as a printing apparatus, such as a laser printer or a dot-impact printer, or a liquid-jet apparatus.

While the present invention has been described with reference to the embodiments and the modifications, the foregoing embodiments of the invention are merely examples for easy understanding of the invention, and the invention is not limited to these. It should be understood that various modifications and alterations may occur without departing from the scope of the appended claims, and the invention includes the equivalents thereof.

The entire disclosure of Japanese Patent Application No. 2007-320628, filed Dec. 12, 2007 is expressly incorporated by reference herein.

What is claimed is:

1. An electronic apparatus comprising:

a plurality of attachment portions to which a plurality of semiconductor storage devices, each of which includes an access determination unit that determines whether the semiconductor storage device is accessed, an input terminal and an output terminal used for connection checking, a normally-closed switching element that electrically disconnects the input terminal from the output terminal when the access determination unit determined that the semiconductor storage device is accessed, and a bypass circuit that electrically connects the input terminal to a reference point through predetermined impedance, are arranged in a predetermined order;

signal lines used to connect the plurality of semiconductor storage devices which are attached to the plurality of attachment portions to one another by bus connection by electrically connecting each of input terminals of the plurality of semiconductor storage devices to corresponding one of output terminals the adjacent semiconductor storage devices as daisy-chain connection, the signal lines being used to access the semiconductor storage devices;

a power supply line that supplies power to the input terminal serving a beginning point of the daisy-chain connection through predetermined impedance;

a reference point connection line that electrically connects the output terminal serving as an end point of the daisy-chain connection to the reference point;

a voltage detection unit that detects a voltage between the input terminal serving as the beginning point and the reference point;

an access execution unit that successively accesses the plurality of semiconductor storage devices;

a first voltage detection unit that detects a voltage between the input terminal serving as the beginning point and the reference point every time the access execution unit accesses one of the semiconductor storage devices; and an attachment-position determination unit that determines whether the plurality of semiconductor storage devices are properly attached to the corresponding plurality of attachment portions in accordance with the voltage detected using the first voltage detection unit.

2. The electronic apparatus according to claim 1, further comprising:

a second voltage detection unit that detects a voltage between the input terminal serving as the beginning point of the daisy-chain connection and the reference point when the electronic apparatus is turned on or when one of the semiconductor storage devices is attached; and a complete-attachment determination unit that determines whether all the plurality of semiconductor storage devices are attached to the plurality of attachment portions in accordance with the voltage detected using the second voltage detection unit.

3. The electronic apparatus according to claim 1, wherein the switching element corresponds to a PNP transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed.

4. The electronic apparatus according to claim 3, wherein the bypass circuit electrically connects the base and the reference point through a resistor.

5. The electronic apparatus according to claim 1, wherein the switching element corresponds to an NPN transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed.

6. The electronic apparatus according to claim 5, wherein each of the plurality of semiconductor storage devices includes an internal circuit at least including the access determination unit, the internal circuit receives power through a power-supply line, and the complete-attachment determination unit executes the determination while the power is supplied to the power-supply line.

7. The electronic apparatus according to claim 1 that performs printing using print-recording material, wherein the semiconductor storage devices are included in print-recording material containers having accommodation portions which accommodate the print-recording material, and the print-recording material containers are to be attached to the plurality of attachment portions.

8. A semiconductor storage device that is to be attached to an attachment portion included in an electronic apparatus, the semiconductor storage device comprising:

an access determination unit that determines whether the semiconductor storage device is externally accessed;

an input terminal and an output terminal used for connection checking, a normally-closed switching element that electrically disconnects the input terminal from the output terminal when the access determination unit determined that the semiconductor storage device is accessed, and a bypass circuit that electrically connects the input terminal to a reference point through predetermined impedance.

9. The semiconductor storage device according to claim 8, wherein the switching element corresponds to a PNP transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed.

10. The semiconductor storage device according to claim 8, wherein the switching element corresponds to an NPN transistor, an emitter of the transistor is electrically connected to the input terminal, a collector of the transistor is electrically connected to the output terminal, a base of the transistor is electrically connected to the access determination unit, and the access determination unit includes a signal output unit that supplies a signal used to disconnect the emitter from the collector to the base when the access determination unit determined that the semiconductor storage device including the access determination unit is accessed.

11. A print-recording material container comprising:

the semiconductor storage device according to claim 8; and a container unit used to contain print-recording material.

12. A control device in which the semiconductor storage device set forth in claim 8 is to be mounted, the control device comprising:

a plurality of attachment portions to which a plurality of the semiconductor storage devices are attached in a predetermined order, and which include first contacted-terminals to be connected to the input terminals of the attached semiconductor storage devices and second contacted-terminals to be connected to the output terminals of the attached semiconductor storage devices;

signal lines used to connect the first contacted-terminals to the second contacted-terminals of the attachment portions by electrically connecting each of second contacted-terminals of the semiconductor storage devices to corresponding one of the first contacted-terminals of the adjacent semiconductor storage devices as daisy-chain connection;

a power supply line that supplies power to one of the first contacted-terminals serving a beginning point of the daisy-chain connection through predetermined impedance;

a reference point connection line that electrically connects one of the second contacted-terminals serving as an end point of the daisy-chain connection to the reference point;

a voltage detection unit that detects a voltage between one of the first contacted-terminals serving as the beginning point and the reference point;

an access execution unit that successively accesses the plurality of semiconductor storage devices;

a first voltage detection unit that detects a voltage between one of the first contacted-terminal serving as the beginning point and the reference point every time the access execution unit accesses one of the semiconductor storage devices; and an attachment-position determination unit that determines whether the plurality of semiconductor storage devices are properly attached to the corresponding plurality of attachment portions in accordance with the voltage detected using the first voltage detection unit.

13. The control device according to claim 12, further comprising:

a second voltage detection unit that detects a voltage between one of the first contacted-terminals serving as the beginning point of the daisy-chain connection and the reference point when the control device is turned on or when one of the semiconductor storage devices is attached; and a complete-attachment determination unit that determines whether all the plurality of semiconductor storage devices are attached to the plurality of attachment portions in accordance with the voltage detected using the second voltage detection unit.

* * * * *